United States Patent [19]

Pokorny et al.

[11] 4,064,814

[45] Dec. 27, 1977

[54] SELF-LEVELING EXTENDABLE TABLE

[76] Inventors: Joseph E. Pokorny, 500 Saylor Way, Las Vegas, Nev. 89107; Richard N. Keller, 2818 E. Tonopah, North Las Vegas, Nev. 89030

[21] Appl. No.: 774,676

[22] Filed: Mar. 7, 1977

[51] Int. Cl.[2] ..... A47B 13/06

[52] U.S. Cl. ..... 108/64; 108/77; 248/188.1; 248/188.3; 248/188.8

[58] Field of Search ..... 108/64, 150, 77; 248/188.3, 188.1, 188.7, 188.8, 164

[56] References Cited

U.S. PATENT DOCUMENTS

| | | | |
|---|---|---|---|
| 1,598,438 | 8/1926 | Hallowell | 248/188.8 |
| 2,787,087 | 4/1957 | Whitman | 108/150 X |
| 2,907,616 | 10/1959 | Sullivan | 108/77 |
| 3,167,290 | 1/1965 | Beckwell | 248/188.3 |
| 3,273,842 | 9/1966 | McMahan | 248/188.7 |
| 3,521,579 | 7/1970 | Stafford | 108/64 |
| 3,758,182 | 9/1973 | Barecki | 248/188.1 |
| 3,866,549 | 2/1975 | Berton | 248/188.1 |
| 3,915,100 | 10/1975 | Sullivan | 108/64 |
| 3,990,663 | 11/1976 | Hendrickson | 248/188.7 |

*Primary Examiner*—Francis K. Zugel
*Attorney, Agent, or Firm*—Seiler and Quirk

[57] ABSTRACT

A self-leveling table has a rectangular top bolted to a unitized base. The base has a horizontal rectangular frame which supports the top fabricated from four welded angle irons. The frame is supported by two pairs of crossed legs, welded at the cross, each of which terminate in a foot. The feet are heavy sheet metal bent slightly so as to touch the floor only at the ends. The table top is fitted with latching devices at each end of the top for attachment of a table extension or another table.

8 Claims, 6 Drawing Figures

SELF-LEVELING EXTENDABLE TABLE

BACKGROUND OF THE INVENTION

This invention relates to a heavy-duty, durable table which has great strength and resistance to deformation under load, but which has sufficient flexibility to longitudinal torque that it has a tendency to self-level when set on rough surfaces, and which has latch mechanisms on the end of each table for aligned attachment of another table or a table extender.

Large showrooms and restaurants often have a difficult problem in arranging tables in various end-to-end configurations on floors which may not have perfectly flat surfaces. This is particularly a problem on concrete surfaces, which tend to be rought, or on wood, linoleum, or tile surfaces which tend to warp. On uneven surfaces, the adjacent table tops will not fit flush to each other when placed end-to-end, resulting in an undesirable discontinuity in the table top surface. In addition, tables placed on uneven surfaces tend to be unstable and rock back and forth on their legs. This problem is particularly aggravating for large showrooms which have two or more shows a night, where dinner is served at the first show but only cocktails are served at later shows. In this case, it is common practice to use tables having leaves to extend the width of the tables during dinner service, and to retract the leaves for cocktail service, thereby providing room for more tables in the showroom. The frequent movement of tables makes the problem of leveling the tables quite difficult. The construction and dimensions of the table of the invention allows slight irregularities in the floor surface to have essentially no effect on the stability of the table or horizontal leveling of the table top. Nevertheless, the table will not deform by bowing either along its length or width if a substantial weight is placed on the top. It is also common for showrooms to maximize the number of people who can be seated when the room is fully booked. In order to do this, small round tables are placed in the aisles which exist for passing between the ends of long parallel rows of narrow rectangular tables. These small tables, which must fit in a space about 18 inches wide, are generally quite unsteady, and are not sufficiently large to permit dinner service for two people. The present invention allows a table extension to be locked in place between the ends of the two tables.

SUMMARY OF THE INVENTION

The effects of stability and self-leveling are achieved through the combination of a rectangular welded angle iron top support, tubular crossed leg members welded at the point of crossing, and solid feet extending beyond the minimum width of the table and contacting the floor only at the ends of the feet. Retractable leaves are used to optionally increase the width of the tables. The self-leveling feature may be enhanced by fasteners attached to the end of each table which lock the top surfaces of abutting tables together, or which lock extenders on to the end of the tables.

DETAILED DESCRIPTION OF THE INVENTION

Figure 1:
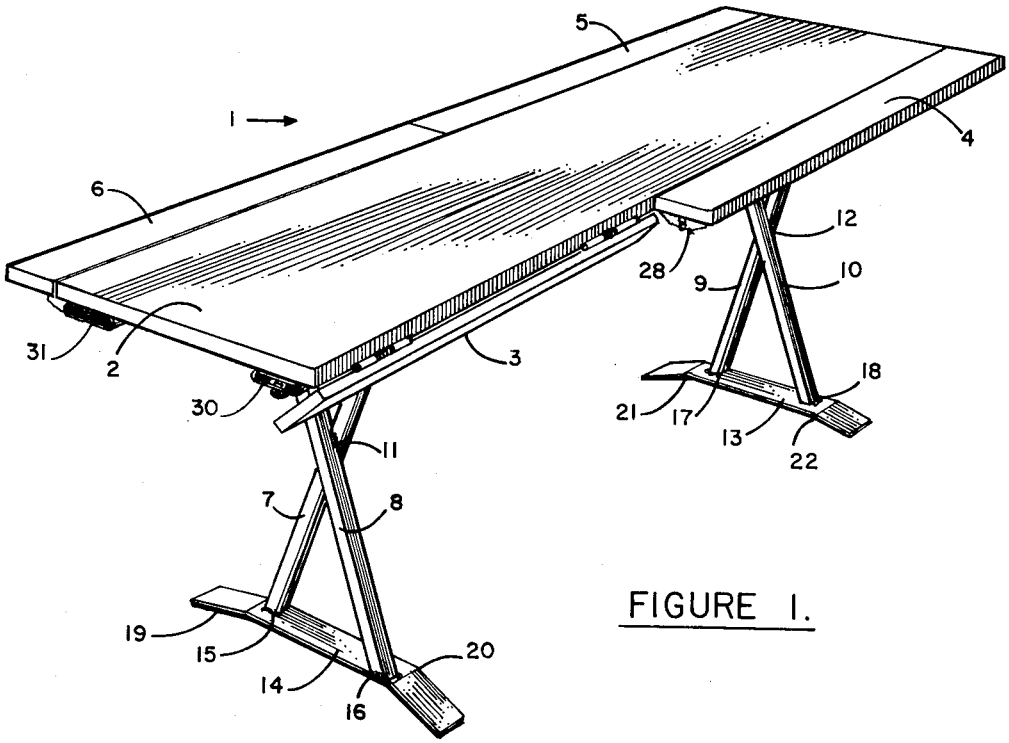
FIG. 1 is a perspective view of the table showing one of the four leaves in non-operating position.

FIG. 1 shows table 1 with top 2 having four leaf members 3, 4, 5, and 6 attached to and disposed lengthwise along the top. Leaf 3 is shown in its out-of-the-way position. Each leaf is attached to the top by hinge mechanisms which are fixed to the underside of the top and the leaf, and which are better seen in FIG. 2. The frame supporting the table top is supported by tubular legs 7–10 which are welded at cross points 11 and 12. The tubular leg may be of any cross-sectional shape, but is preferably square or rectangular. Good results have been obtained with 1 inch square steel tubing with 0.120 inch wall thickness. The legs are welded to feet 13 and 14 at weld points 15–18. The feet are fabricated from single flat steel bars which are bent slightly downward at points 19–22 such that only the ends of the feet contact the floor surface. A very narrow bend, leaving a space of about 1 inch between the center of the feet and the floor, is adequate. The feet are fabricated from heavy steel of about ½ inch thickness to provide stability, strength, and weight to the table. It has also been found that the feet should be at least 2 inches and preferably at least 2½ inches wide to provide proper stability and leveling capability for the table. The legs extend in length to a point slightly less than the width of the table top when the leaves are in fully extended position. For example, if the width of the table is 26 inches with leaves extended, the feet should be about 22–24 inches long. The overall height of the table is about 2½ feet.

Figure 2:
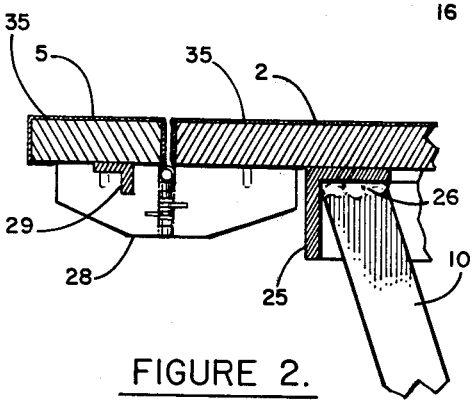
FIG. 2 is a more detailed view of the leaf hinge and frame support.
Figure 3:
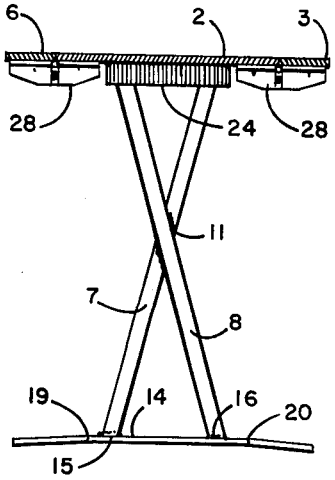
FIG. 3 is a section end view of the table, the section being taken just inside the fastening mechanisms.
Figure 6:
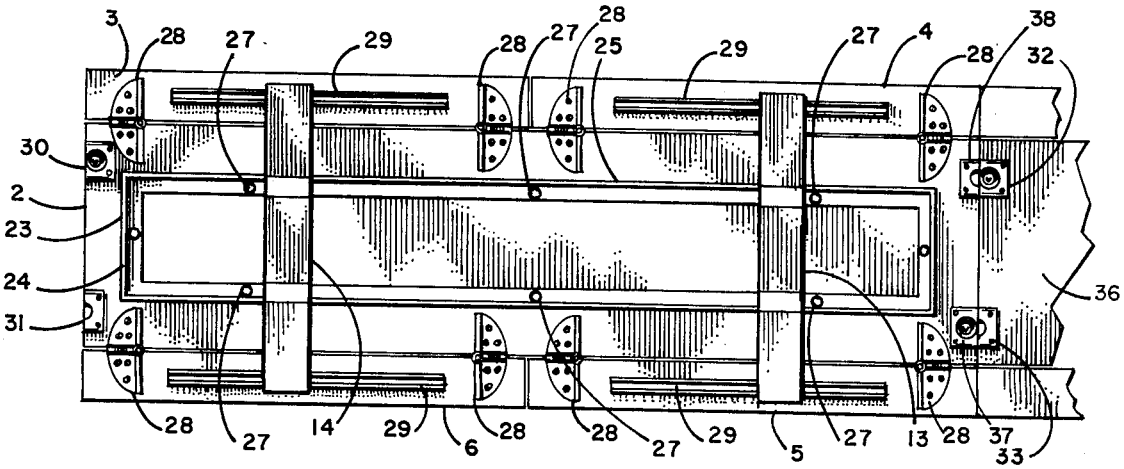
FIG. 6 is a bottom view of the table.

The upper ends of tubular legs 7–10 are cut along a horizontal plane and welded to the upper frame 23, which can be seen in FIG. 6, and, in cross-section, in FIG. 2. The upper frame comprises four angle iron members welded into rectangular form. The horizontal flanges of the angle irons extend inwardly with respect to the vertical flanges, to provide structural stability and to facilitate welding of the angularly approaching leg members. The welded connection 26 of leg 10 to side frame member 25 is shown in FIG. 2. End frame members 24 and side frame members 25 are located as near as possible to the edge of the table to provide structural stability and to prevent bowing of the top along the length or width of the table. In general, the proximity of the side frame members 25 to the edge of top 2 will be limited by the extensions of the inner side of the flanges on hinges 28, as shown in FIG. 6. The angle iron frame members are very resistant to bowing caused by a vertical force along their lengths because of the vertically disposed flange construction, but the frame is susceptible to slight twisting caused by a torque applied along its length. This torque is effected when the feet are on uneven parts of the floor by the weight of the top itself and by any heavy objects placed on the table. In other words, if the end of one foot is placed on a slightly higher level than the ends of the other feet, the construction of the table will create a slight torque on the frame which will tend to return the top to a horizontal position. In addition, the corresponding foot on the same side as the elevated foot would not raise off the floor of the flexibility of the angle iron frame. If the rectangular frame were fabricated from flat sheet metal strips rather than angle irons, the frame would have sufficient torque flexibility but insufficient strength, resulting in a tendency of the table to sag or bow under a weight placed on its top. On the other hand, a tubular frame would have sufficient strength but insufficient flexibility to provide leveling.

The heavy tubular construction of legs 7–10 provides great strength to the table. However, the crossed configuration of each leg pair allows slight but sufficient flexibility to contribute to leveling of the top when the feet are set on a slightly irregular surface.

The table top 2 is heavy wood such as ¾ inch plywood and is attached to the upper frame with bolts secured with internal lock washers, or heavy screws, at locations 27 as shown in FIG. 6. If bolts are used, care must be taken to sink the upper end of the bolt into the top of the table so that protrusion will not be visible on the table top. The top is covered with a padded covering, such as ozite carpeting, and a 36 ounce vinyl covering (shown in cross-section as 35 in FIGS. 2 and 5). These top coverings are stretched over the wooden top and stapled to the underside of the table. The leaves are fabricated from the same type of material as the table top, and are similarly covered with ozite and vinyl.

In order to best obtain the self-leveling feature of the invention, a relatively long ratio of length to width of the top is desirable. The top should be at least 54 inches long and preferably at least 72 inches long. Tops as long as 108 inches have been successfully made according to the invention. The maximum width, with leaves extended, is less than 30 inches and is preferably 26 inches. Accordingly, a length to width ratio of 2:1 and preferably about 3:1 is desirable. Each leaf 3–6 is secured to the table top by two hinges 28 which rigidly support the leaf in a fully extended position in the plane of table top 2, or retain the leaf in an out-of-the-way position when it is not in use. These hinges are spring operated such that when in an inoperative position, the leaf is urged to fold back flat against the underside of the table. These hinges are well-known and are described in detail in Sullivan, U.S. Pat. No. 2,907,616, issued Oct. 6, 1959, entitled "Leaf Hinging Mechanism For Tables."

Figure 5:
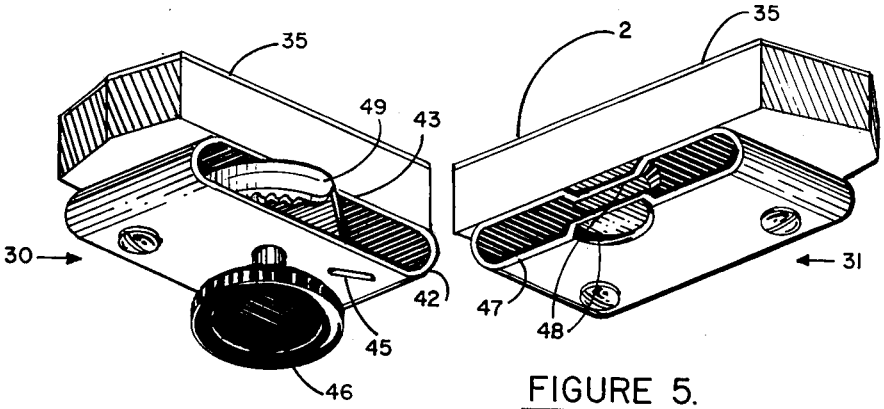
FIG. 5 is a perspective view of the male and female parts of a fastening device used to fasten the tables in end-to-end fashion, or to fasten a table extender to the table.

Leaf stiffeners 29, shown in FIG. 6 and, in cross-section, in FIG. 2, are attached to the back of each leaf in order to prevent bowing of the leaf along its length. In addition, these stiffeners act as a stop to prevent the leaves from folding back completely flush to the underside of the table when they are in an out-of-the-way position by abutting against the underside of top 2. This enables the leaves to be easily reached for retrieval to an operative position, yet allows them to remain sufficiently hidden so as to not interfere with the normal operation of the table when in an inoperative position. The leaf stiffeners are short angle iron members disposed lengthwise and affixed by screws to the back of each leaf, and are seen in FIGS. 5 and 6, and in cross-section in FIG. 2.

An important feature of the table is the ability to lock the table end-to-end with another table. This locking feature may be accomplished by attaching the male part of a locking device to one end of a plurality of tables, and the female part to the other end, and aligning the tables appropriately end-to-end such that the male and female parts may be interlocked. Perspective views of the male and female parts of a locking device are shown in FIG. 5. The use of only one locking device on each end of the table permits only one arrangement of the tables; i.e., the male end of one table must be aligned to the corresponding female end of the adjacent table or table extender. In addition, the stability of an extender is not sufficient if only one latching device is used. Accordingly, it is preferred to use two latches on each end of each table. A male part and a female part are fixed to each end of each table or extender as shown in FIG. 6, which also shows a table extender 36 locked in place on the end of table 2. Male parts 30 and 37 are attached by heavy duty screws to diagonally opposing corners of top 2, and female parts 31 and 38 are similarly affixed to the other diagonally opposing corners. By this arrangement of male and female parts, either end of any table or extenders having similarly arranged latch parts can mate with either end of table 1. In FIG. 6, female fastener part 38 and male part 37 are shown in locked position to corresponding counterparts 32 and 33 on table extender 36.

Figure 4:
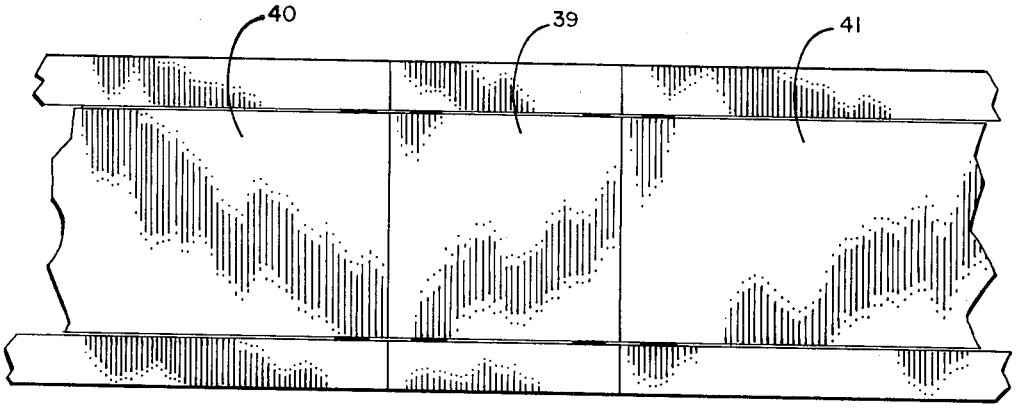
FIG. 4 is a top view of two tables with a table extender locked into place between the two tables.

Locking two similar tables end-to-end provides stability to both tables, and augments the self-leveling feature of the table, assuring a level interface between adjacent tables. The locking mechanism also permits extenders to be placed on the end of one table, or between two tables. Extenders consist of table top sections having the same width and made from the same material as the top, but without supporting frame or leg members. If desired, the extender can be reinforced on the underneath side with longitudinally fixed angle iron supports for strength. The length of the extenders is generally 18 inches, which is considered adequate for one additional place setting but may be about 36 inches for two place settings. The extenders preferably have leaves hinged in the same manner as the basic table; generally, for the extenders, one hinge is adequate for each leaf. FIG. 4 shows extender 39 locked in place between tables 40 and 41. The leaves of the extender are shown in the fully extended position. FIG. 6 also shows an extender 36 fixed in place adjacent to table 2 with latch parts 32, 33, 37, and 38.

The extenders have male and female latch parts on each end arranged in the same manner as the basic tables. Accordingly, in addition to serving as an extension for one table, the extender can serve as a bridge between two tables as shown in FIG. 4. The extender can be put in place across an aisle after the tables are filled to provide extra seating space.

Any latch device having two separate interlocking parts, and which does not protrude from the end of the table in its inactive position, may be used. Good results have been obtained with commercial fasteners manufactured by Simmons Fastener Corporation, Albany, N.Y., model B-1311, illustrated in FIG. 5. Male part 30 consists of housing 42 containing semicircular latch wheel 43 eccentrically mounted through apertures in the housing. Ratchet mechanism 44 on the bottom of the latch wheel frictionally engaging ridge 45 on the internal lower surface of housing 42, and a corresponding ratchet on the upper surface of the latch wheel (not shown) engaging a similar indentation on the internal upper surface of the housing, require substantial torque to be applied on handle 46 to rotate the wheel in the housing. This prevents free movement and unintentional loosening of the latch, and allows the wheel to lock into place when it has engaged the female part. Torque is applied by means of a handle, which may be a hand-operated wheel as shown, or which may be a removable hexagonal wrench which fits a receiving well in place of the illustrated handle stem. The wrench may be separately carried or may be welded into the handle receiver to become a permanent fixture of the male part.

The female part 31 of the latch consists simply of housing 47 with semicircular indentations 48 in the open front of the housing. In operation, as the latch handle on male part 30 is turned clockwise, the leading edge 49 of the latch wheel emerges from housing 42. The wheel is mounted eccentrically such that the distance from the center of rotation of the wheel to the periphery of the wheel is the maximum at the leading edge 49, and becomes progressively shorter as the wheel is turned. The leading edge engages the indentations 48 of the female latch part, with the raised periphery of the male part passing behind the indentations. As the wheel is turned, the effective radius of the periphery becomes increasingly shorter, urging the female part toward the male part until a lock is obtained. The lock is released by reversing the rotation of the wheel.

Although several embodiments of the invention have been shown, it will be understood that the description is intended to be illustrative rather than restrictive, and many changes, omissions, or additions can be made with respect to the preferred embodiment without departing from the scope of the invention.

We claim:

1. A table which tends to be stable and to maintain the top in a horizontal plane when set on a slightly irregular surface comprising a rectangular horizontal flat top affixed to a base, the base comprising:

a horizontal rectangular angle iron support frame, a plurality of pairs, disposed lengthwise, of tubular crossed legs, the legs of each pair being fixably mounted to and depending downward from opposing lengthwise sections of the angle iron support frame, and being immovably attached to each other at the point of crossing, each pair of legs affixed to a foot comprising a substantially flat member situated widthwise to the table, said flat member being slightly arched so as to contact a supporting floor surface only at the ends of the flat member.

2. The table of claim 1 having fastening means at each end of the rectangular top for removably attaching to the top in the same plane a horizontal planar surface of similar width and thickness as the top.

3. The table of claim 1 having one male part and one female part of fastening means attached to each end of the top, the male parts being located on diagonally opposing sides of the ends of the top such that a planar surface having similarly arranged fastening means may be locked into a horizontal position adjacent to and in the same plane as the top.

4. The table of claim 1 wherein the length of the horizontal flat top is at least twice its width.

5. The table of claim 1 wherein the length of the horizontal flat top is at least three times its width.

6. The table of claim 1 wherein a plurality of leaf members are hingedly associated with the rectangular horizontal flat top, the leaf members being movable between a fixed position extending in the same plane as the top, and a second fixed position in which the leaves are folded back under the top.

7. The table of claim 2 wherein the length of the horizontal flat top member is at least twice its width when the leaf members are in the fully extended position.

8. The table of claim 2 wherein each foot has a width of at least 2 inches and a length greater than the width of the table when all of the leaves are in the folded back position but less than the width of the table when all of the leaves are in the fully extended position.

* * * * *